United States Patent [19]

Schold

[11] 4,044,957

[45] Aug. 30, 1977

[54] APPARATUS FOR DISPERSING FINELY DIVIDED SOLID PARTICLES IN A LIQUID VEHICLE

[76] Inventor: George R. Schold, 7909 2nd St. North, St. Petersburg, Fla. 32507

[21] Appl. No.: 657,723

[22] Filed: Feb. 13, 1976

[51] Int. Cl.[2] ..... B02C 17/16

[52] U.S. Cl. ..... 241/46.11; 241/46.15; 241/74

[58] Field of Search ..... 241/46 R, 46.02, 46.11, 241/46.15, 46.17, 74, 171, 172

[56] References Cited

U.S. PATENT DOCUMENTS

| | | | |
|---|---|---|---|
| 3,653,600 | 4/1972 | Schold | 241/74 |
| 3,802,633 | 4/1974 | Schold | 241/172 |
| 3,844,490 | 10/1974 | Schold | 241/74 |

*Primary Examiner*—Granville Y. Custer, Jr.
*Attorney, Agent, or Firm*—Frank R. Thienpont

[57] ABSTRACT

Apparatus for dispersing solid particles in a liquid vehicle utilizing a separator surrounding an agitating shaft and having a filter screen surrounding the separator said filter screen being of a thin deformable screen material which can be pressed into place around the separator body and held in place thereon by a coiled spring surrounding the screen and separator body and detachably secured in place around the screen and body.

8 Claims, 7 Drawing Figures

Fig. 4.
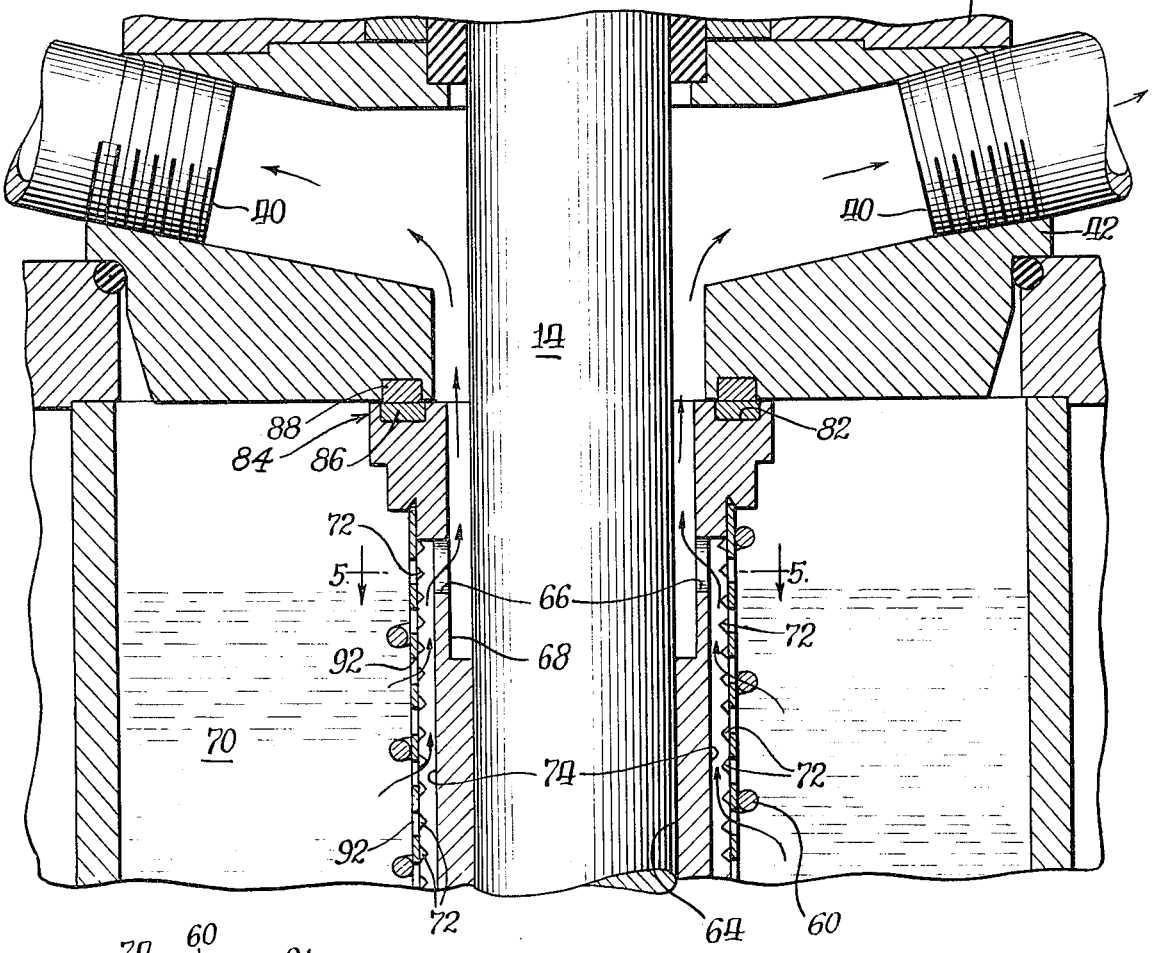
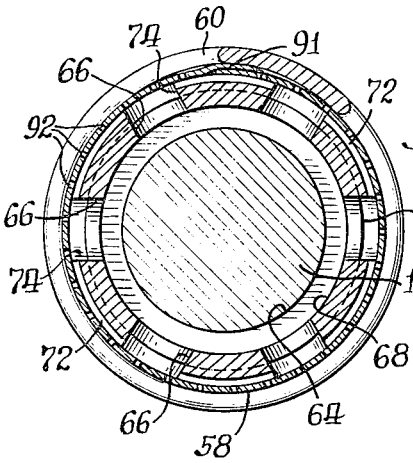
Fig. 5.
Fig. 6.
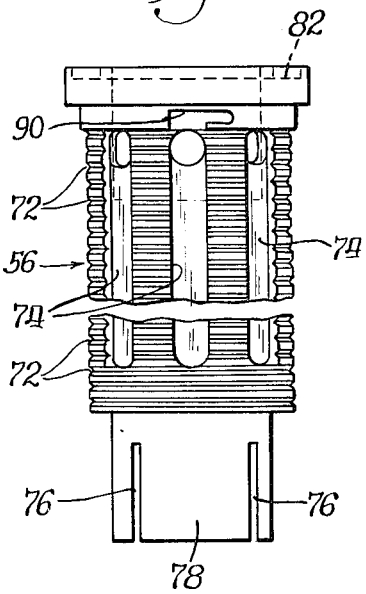
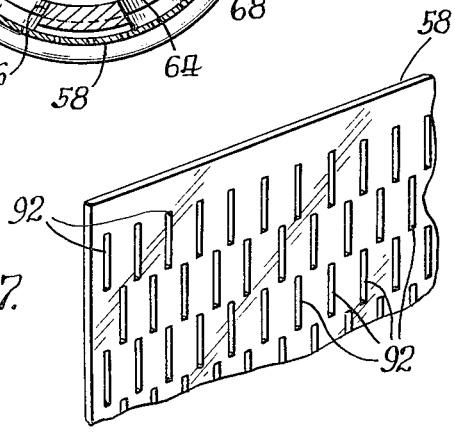
Fig. 7.

APPARATUS FOR DISPERSING FINELY DIVIDED SOLID PARTICLES IN A LIQUID VEHICLE

BACKGROUND OF THE INVENTION

This invention relates to apparatus for uniformly producing finely divided particles and uniformly distributing such finely divided particles in a liquid vehicle.

The invention herein constitutes an improvement to apparatus of the type disclosed in U.S. Pat. Nos. 3,653,600 issued Apr. 4, 1972, and 3,844,490 issued Oct. 29, 1974.

U.S. Pat. No. 3,653,600 discloses a rotor separator having a filter screen disposed on the outside of the rotor separator. It eventually becomes necessary to remove such screens either for replacement or cleaning. U.S. Pat. No. 3,844,490 discloses the use of a split screen, i.e., a screen divided into a number of segments, so that the screen may be more easily installed and removed. The separator assembly in either case still incorporates a filter screen unit which is relatively expensive to manufacture and not always readily available. Accordingly, it is desirable to simplify the separator assembly as much as possible aiming toward an increased ease of installation and a reduced manufacturing cost.

SUMMARY OF THE INVENTION

A principal object of this invention is to provide a separator assembly having a filter screen which is inexpensive, easily obtainable and easy to install and remove. Another object of this invention is to provide a separator assembly having a filter screen associated therewith and a coil spring surrounding the filter screen to secure the latter in place on the separator assembly.

Other objects and advantages of this invention will become more readily apparent when considered in connection with the accompanying drawings.

BRIEF DESCRIPTION OF THE DRAWINGS

FIG. 4 is an enlarged sectional view in elevation of the upper portion of the mixing vessel showing the upper portion of the rotor separator in section;

FIG. 5 is a plan view taken along line 5—5 of FIG. 4;

FIG. 6 is a view in elevation of the rotor separator body;

FIG. 7 is a view in perspective of a portion of a filter screen used in connection with the rotor separator shown herein.

DESCRIPTION OF A PREFERRED EMBODIMENT

Figure 1:
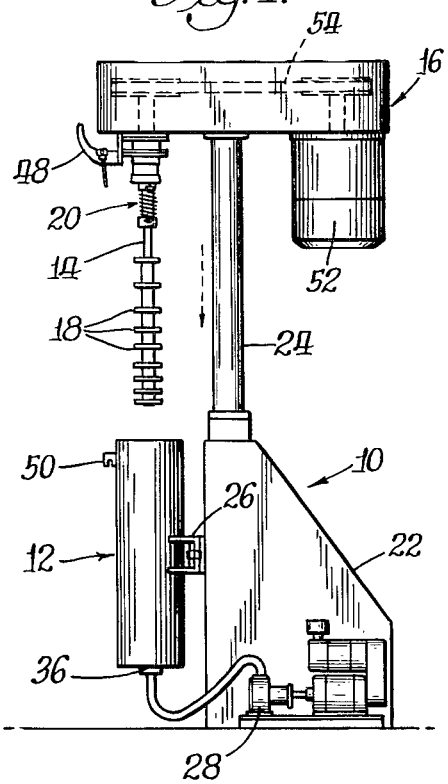
FIG. 1 is a side view in elevation of apparatus embodying the present invention.
Figure 2:
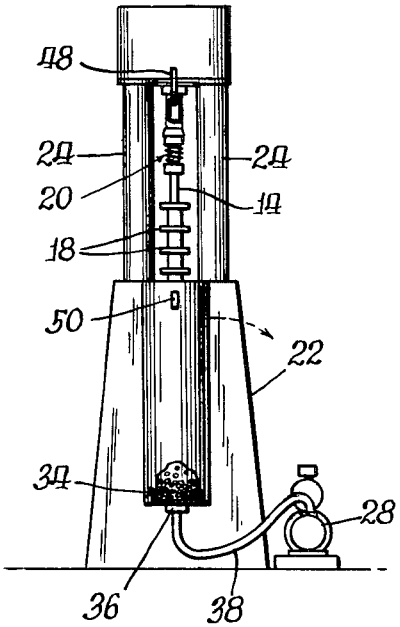
FIG. 2 is a front view of elevation of the apparatus of FIG. 1.

We refer now to the drawings wherein like reference characters in the several views designate similar parts. Referring to FIG. 1, 10 designates generally the dispersing apparatus or mill embodying the invention herein. The dispersing apparatus 10 comprises a generally cylindrical mixing vessel 12, a rotatable agitator shaft 14, a drive unit 16 for driving the shaft 14, a plurality of impellers or agitator discs 18 mounted on the shaft 14 and a rotor separator assembly 20 secured to the shaft 14. The vessel 12 usually is mounted on a suitable supporting frame 22. In some units, preferably of the smaller type, the drive unit 16 may be secured by appropriate means to the upper end of one or more rams or pistons 24. The latter form a part of a hydraulically operated air over oil hydraulic lifting arrangement by which the drive unit 16 and attached agitator shaft 14 may be raised to a non-operating position as indicated in FIG. 1. Again in some units, preferably of the smaller type, the mixing vessel 12 may be pivotally mounted on the supporting frame by a pivotal mounting 26 as seen in FIG. 1. Then when the agitator shaft 14 is withdrawn from the vessel 10, the latter may be pivoted as indicated by the arrow in FIG. 2 to dump the dispersing media and the material remaining in the vessel.

A pump 28 is associated with the mill 10 to introduce permixed material into the vessel 12 to be processed and to force the material through the vessel under pressure. A circumferentially extending jacket 30 is radially spaced from the vessel 12 to form therewith a chamber 32 through which a temperature controlling fluid may be circulated by appropriate means as described, for example, in the aforementioned patents. During operation, the vessel 12 is partially filled with a dispersing media such as steel shot 34, for example, but other types of dispersing media can also be used.

Figure 3:
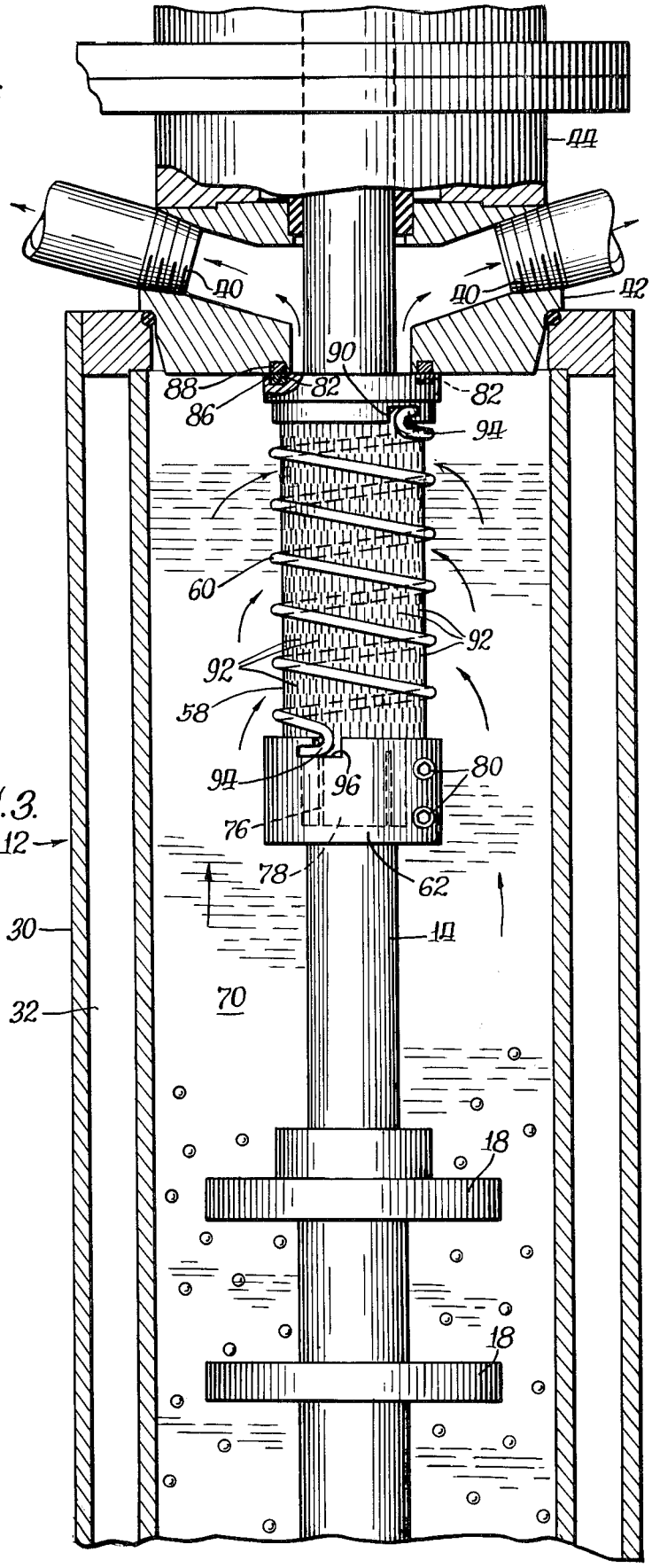
FIG. 3 is an enlarged sectional view in elevation of the upper portion of the mixing vessel showing the rotor separator in place on the shaft.

In the illustrated embodiment the vessel 12 during operation of the unit is closed at both its upper and lower ends. An inlet 36 is formed in the lower end of the vessel through which product to be processed is pumped from pump 28 via conduct 38. Product outlet means which may comprise a plurality of outlets 40 is disposed at the upper end of the vessel and may be formed in the lower part of the bearing housing. The upper end of the vessel is closed by a cover plate 42 which may be formed as an integral part of the shaft bearing housing 44. The cover plate 42 forms a sealed closure with the upper end of the mixing vessel 12 by a seal means such as an O-ring 46. When the drive unit 16 and agitator shaft 14 are lowered by the hydraulic lifting arrangement into an operating position, the cover plate 42 seals the top of the vessel as shown in FIG. 3 and is locked in position along with the drive unit and agitator shaft by a toggle mechanism 48 which engages bracket 50 on the mixing vessel.

The shaft 14 is rotatably supported in the axially extending bearing housing 44 in a conventional manner by upper and lower bearings (not shown).

The drive unit 16 may include a variable speed motor 52 drivingly connected to the shaft 14 by a belt and pulley arrangement 54. An adjustable control for varying the tension on the belt and pulley arrangement may be used to provide additional shaft speed control.

The separator assembly 20 includes a separator body 56, a filter screen element 56 surrounding the separator body, a coil spring 60 for securing the screen element around the separator body and a collar 62 surrounding the lower end of the separator body 56 for securing the latter to the shaft 14.

The separator body 20 may comprise an elongated cylindrical construction having a bore 64 for slidable engagement with shaft 14. A plurality of circumferentially spaced openings or passages 66 are formed in the upper portion of the wall of the separator body. An enlarged central bore portion 68 is formed in the upper end of the separator body. The passages 66 and bore portion 68 establish fluid communication between the mill chamber 70 and the outlet means 40. The separator body 56 also has formed in the outer surface thereof a plurality of circumferentially extending grooves 72 which provide passages for product flow after it has passed through the filter screen 58. In addition, there are formed in the outer surface of the separator body a plurality of substantially axially extending grooves 74. The upper ends of these grooves 74 are in communication with the openings or passages 66 as well as with the circumferentially extending grooves 72. Thus, it will be observed that processed product flowing through the filter screen over its complete circumference and will enter the grooves 72 and then flow into the axially extending grooves 74 as well as directly into grooves 74 and then upwardly in the latter to the transverse openings or passages 66. Other passage means than grooves 72 and 74 and other and larger openings than openings 66 could be provided to allow for adequate flow as long as a solid substantial backing for the screen element is provided.

The lower end of the separator body 56 may have formed therein a plurality of slots 76 so that segments 78 between the slots are somewhat flexible. This enables the split clamping collar 62 attached to the lower end of the separator body 56 over the segments 78 by means of bolts 80 to tightly secure the body 56 to the shaft 14.

The upper end of the separator body 56 may be provided with an appropriate seat such as a groove 82 or counterbore to accommodate a sealing ring 86 which will comprise the rotating portion of a seal unit 84. The stationary seal ring 88 of the seal unit 84 may be secured in an appropriate manner to the cover plate. Other seal means probably could be used here, but in any event, the intent is to utilize an appropriate seal means which will prevent processed product from reaching the outlet 40 without passing through the separator assembly. The sealing unit 84 is arranged between the upper end of the separator body 56 and the cover plate in such a manner as to prevent the pressure within the mill from acting on the sealing unit. All the mill pressure is taken by the screen element. A peripheral slot 90 is formed in the upper end of the separator body 56 to receive one end of the coil spring 60 as a securing means.

The filter screen element 58 may comprise a thin, flat, flexible sheet metal material, a portion of which is illustrated in FIG. 7. One type of screen element that has been used is made of stainless steel and preferably is about 0.015 inches in thickness. It may have formed in it a plurality of staggered slots 92 which may be approximately 0.012 inches in width and 0.100 inches in length. Other arrangements of screen openings may be used. The screen element is thin and flexible which makes it easily deformable. It is, therefore, easily hand formed around the separator body 56 to fit tightly against the body. In the assembled condition on the separator body the adjacent free edges of the screen overlap and preferably are not secured together as seen at 91. Accordingly, installation and removal of the screen in the assembly is extremely simple.

The coil spring 60 is designed with an internal diameter so that in the separator assembly 20 it will fit tightly around the screen element 58 and press the latter tightly against the outer surface of the separator body. The coil spring 60 is provided with loop or hook means 94 at each of its ends to engage the slot 90 at the upper end of the separator body and the slot 96 in the collar 62 to secure the spring 60 firmly in place in the assembly. While other means could be attached surrounding the filter screen to secure the latter in place, a coil spring has been found particularly effective.

In a mill of the type herein illustrated, the operation is the same as in the device disclosed in the patents referred to above. During operation of the mill the product injected into the mill under pressure is mixed and ground as a result of the agitation of the dispersing media by the rotating shaft agitator discs. Depending on the relative viscosity of the products being processed, the grinding media such as metal shot will tend to rise in the mill with the product. With a more viscous product, there will be a tendency for more of the grinding media to rise to the upper part of the mill chamber 70 and into the vicinity of the filter screen. This is undesirable for the reason that the screen will be subject to additional wear. In this connection, the coil spring serves the additional function of deflecting the grinding media away from the screen. Whether it deflects the grinding media upwardly or downwardly depends, of course, on the direction of winding of the coil spring in relation to the direction of turning of the shaft. If, for example, the shaft turns clockwise when viewed from the top down and the coil spring is wound counterclockwise looking from the top down, then, during operation, the grinding media such as metal shot, will be deflected downwardly and back into a lower part of the mill chamber which is the desirable effect.

In order to make the coil spring even more effective to deflect grinding media away from the filter screen element and toward a lower portion of the mill chamber, the coil spring might be constructed of a flat strip material which might be on the order of $\frac{1}{4}$ to $\frac{3}{8}$ of an inch in width. This would provide a greater deflecting surface.

Servicing of the rotor separator assembly is a relatively simple matter. The drive unit and agitator shaft may be raised the desired distance after release of the toggle mechanism 48. To remove the filter screen for cleaning or replacement, one needs only to free collar 62 by loosening bolts 80. This also loosens the spring 60 from its secured position and allows it to be slid from around the screen which can then be removed for cleaning or replacing. This also conveniently exposes the separator body for cleaning.

It will be apparent that in operation the processed product is forced upwardly through the mill chamber 70 under pressure. The pressure forces it radially upwardly through filter screen 58 into grooves 72 and 74, through openings 66, into enlarged bore portion 68 and upwardly along shaft 14 to outlets 14.

While an improved rotor separator assembly has been disclosed herein in connection with a mill in which the agitator shaft assembly can be lifted from the mixing vessel by a hydraulic lifting arrangement, it will be appreciated that this improved rotor separator assembly can be used in larger mills in which the agitator shaft is not lifted from the mixing vessel. In such case, adequate size manholes or ports may be provided in the wall of the mixing vessel to reach the separator assembly.

While a preferred embodiment of the invention has disclosed, it will be appreciated that this is shown by way of example only, and the invention is not to be limited thereto as other variations will be apparent to those skilled in the art and the invention is to be given its fullest possible interpretation within the terms of the following claims.

What is claimed is:

1. In apparatus for deagglomerating and dispersing solid particles held in agglomerated form and carried in a liquid vehicle while in a mixing vessel in which the particles are subjected to the action of a dispersing media while being forced to flow through the interior of the vessel and subjected to a contrifugal and agitating action therein which causes the dispersing media to be thrown outwardly and separated from the flow path of the product of liquid mixture being processed;

a rotatable shaft extending into said vessel and adapted to be driven from a power source;

a dispersing media separator located interiorly of the mixing vessel so as to be positioned in said flow path and having means for the admission of the processed product thereinto and therethrough so that the product is forced to travel through said dispersing media separator in a direction opposite to that generated by the normal centrifugal force;

said separator comprising a body surrounding and attached to said shaft and rotatable therewith;

means defining inlet and outlet means to and from said separator, said separator outlet means being in fluid communication with said vessel outlet;

a flexible filter screen of sheet material surrounding and lying against the outer surface of said body;

coil spring means surrounding and lying against said filter screen to secure said filter screen to said body; and means for detachably securing said coil spring means in place around said body.

2. The apparatus of claim 1 including means defining a plurality of axially spaced circumferentially extending grooves formed in the outer surface of said body through which filtered product may flow, said grooves being in communication with said outlet means from said separator.

3. The apparatus of claim 1 including means defining substantially axially extending grooves formed in the outer surface of said body into which filtered product flows after penetrating said filter screen, said axially extending grooves being in communication with said outlet means from said separator.

4. The apparatus of claim 1 wherein said flexible filter screen comprises a sheet of screen material which may be hand formed around the separator body.

5. The apparatus of claim 1 wherein said coil spring means has formed at its opposite ends means for securing the spring in place around said filter screen.

6. The apparatus of claim 1 wherein said coiled spring means is coiled in a direction opposite to the direction of rotation of said shaft whereby said spring means is effective to deflect dispersing media downwardly into the mixing vessel.

7. In apparatus for deagglomerating and dispersing solid particles held in agglomerated form and carried in a liquid vehicle while in a mixing vessel in which the particles are subjected to the action of a dispersing media while being forced to flow through the interior of the vessel and subjected to a centrifugal and agitating action therein which causes the dispersing media to be thrown outwardly and separated from the flow path of the product or liquid mixture being processed;

a rotatable shaft extending into said vessel and adapted to be driven from a power source;

a dispersing media separator located interiorly of the mixing vessel so as to be positioned in said flow path and having means for the admission of the processed product thereinto and therethrough, so that the product is forced to travel through said dispersing media separator in a direction opposite to that generated by the normal centrifugal force;

said separator comprising a body surrounding and attached to said shaft and rotatable therewith;

means defining inlet and outlet means to and from said separator, said separator outlet means being in fluid communication with said vessel outlet;

a flexible filter screen of sheet material surrounding and lying against the outer surface of the outer surface of said body;

compression clamping means surrounding and lying against the outer surface of said filter screen to secure said filter screen to said body.

8. The apparatus of claim 7 including means defining flow channels in the outer surface of said body through which product may flow after penetrating said filter screen, said flow channels being in communication with said outlet means from said separator.

* * * * *